US005919276A

United States Patent [19]

Jeffrey

[11] Patent Number: 5,919,276

[45] Date of Patent: Jul. 6, 1999

[54] USE OF MIXED ALKALINE EARTH-ALKALI METAL SYSTEMS AS EMISSIONS REDUCING AGENTS IN COMPRESSION IGNITION ENGINES

[75] Inventor: Gareth Charles Jeffrey, Bracknell, United Kingdom

[73] Assignee: Ethyl Petroleum Additives Limited, Bracknell, United Kingdom

[21] Appl. No.: 09/020,965

[22] Filed: Feb. 9, 1998

[51] Int. Cl.[6] ..... C10L 1/30; C10L 1/18; C10L 1/14

[52] U.S. Cl. ..... 44/370; 44/373; 44/374; 44/385

[58] Field of Search ..... 44/370, 373, 374, 44/385

[56] References Cited

U.S. PATENT DOCUMENTS

| | | | |
|---|---|---|---|
| 2,612,439 | 9/1952 | McNab | 44/370 |
| 2,742,351 | 4/1956 | Rogers et al. | 44/370 |
| 3,012,969 | 12/1961 | van der Minne et al. | 252/153 |
| 3,078,663 | 2/1963 | Rocchini et al. | 44/370 |
| 3,078,664 | 2/1963 | Rocchini et al. | 44/370 |
| 3,594,137 | 7/1971 | Lonstrup | 44/373 |
| 3,637,356 | 1/1972 | Vanderlinden et al. | 44/373 |
| 3,798,012 | 3/1974 | Le Suer | 44/373 |
| 3,849,084 | 11/1974 | Skinner | 44/370 |
| 4,104,180 | 8/1978 | Burnop | 44/373 |
| 4,129,508 | 12/1978 | Friihauf | 44/373 |

FOREIGN PATENT DOCUMENTS

| | | |
|---|---|---|
| 423744 | 4/1991 | European Pat. Off. . |
| 790473 | 4/1955 | United Kingdom . |
| 2248068 | 3/1992 | United Kingdom . |
| 93/06195 | 4/1993 | WIPO . |
| 96/34075 | 10/1996 | WIPO . |

*Primary Examiner*—Margaret Medley
*Attorney, Agent, or Firm*—Dennis H. Rainear; Thomas Hamilton

[57] ABSTRACT

The present invention relates to fuel compositions containing a base fuel and a fuel additive, wherein the fuel additive comprises a mixture of calcium and either alkali metals, alkaline earth metals other than calcium or mixtures thereof. The present invention also relates to a method for reducing emissions in engines burning said fuel compositions.

13 Claims, No Drawings

USE OF MIXED ALKALINE EARTH-ALKALI METAL SYSTEMS AS EMISSIONS REDUCING AGENTS IN COMPRESSION IGNITION ENGINES

BACKGROUND OF THE INVENTION

The present invention relates to fuel compositions which yield reduced emissions and a method for reducing emissions in compression ignition engines burning said fuel compositions. According to the present invention it has been discovered that reduced particulate emissions, upon the burning of fuels, are obtained by the addition of low levels of a fuel additive, comprising mixtures of calcium salts with alkaline earth metal salts other than calcium salts and/or alkali metal salts, to the fuel.

Fuels used in compression ignition engines give off in the exhaust of the engine particulates which are harmful pollutants. These particulates include not only those that exist as visible smoke or soot when the engine is overloaded or when the engine is worn or dirty, but also those that are invisible and emerge from partly loaded clean engines. Particulates are solid materials expelled from the engine which typically have a size less than 100 microns, with the vast majority being 10 microns in size or less. Chemically, particulates will be composed of carbon, in the form of mixtures of partially oxidized carbon and hydrocarbon species; sulfur, mainly in the form of sulfates; and other non volatile components, such as metals from engine wear, lubricant oil, and parts of the additives themselves.

There have been many attempts at finding suitable smoke suppressants for use in middle distillate fuel compositions. See, for example, U.S. Pat. Nos. 3,410,670 and 3,413,102 and GB 888,325. Prior smoke suppressants include organic compounds of barium, particularly the barium carbonate overbased barium sulfonates, which are effective at substantially reducing the amount of smoke exhaust from an engine. However, there are serious questions concerning the use of barium compounds as smoke suppressants since barium compounds are known to be toxic upon ingestion by human beings at high dosages.

More recently, transition metal compounds, particularly manganese and iron, have been used for reducing smoke and other particulate emissions in the combustion of fuels. These transition metal compounds have been used alone or in combination with alkaline earth metals or alkali metals.

U.S. Pat. No. 4,207,078 discloses diesel fuel compositions containing manganese tricarbonyl compounds and oxygenated compounds. The reference does not teach the use of low levels of alkali metals and/or alkaline earth metals in reducing emissions.

European Patent No. 0 078 249 and GB 2 248 068 disclose additives with combustion-promoting and soot-inhibiting activity for combustion fuels. The additives are selected from transition metals, alkaline earth metals and mixtures thereof. The references requires the presence of a transition metal and thus do not teach the additive mixtures of the present invention.

U.S. Pat. Nos. 5,011,502 and 5,087,267 and European Patent Application No. 0394715 A1 disclose fuel additives derived from seawater. The additives contain mixtures of metal salts. However, these compositions contain elements, such as boron, silicon, iron, aluminum, chromium and titanium, which are not within the scope of the metals intended for use in the present invention.

WO 95/04119, WO 96/34074 and WO 96/34075 disclose fuel additives for reducing the emission of particulates comprising alkali, alkaline earth or rare earth complexes. The references fail to teach additives comprising the combinations of metals set forth in the present invention.

Currently, the United States Environmental Protection Agency (EPA) is proposing a de minimis provision for some atypical fuels and fuel additives (F/FAs), i.e., maximum concentrations or emission rates for atypical elements below which manufacturers of F/FAs containing such elements would be excused from some or all of the testing requirements for the product (Federal Register, Vol. 61, No. 134, Thursday, Jul. 11, 1996, pages 36535–36543). In the gasoline and diesel fuel families, an atypical F/FA is one which contains one or more elements other than carbon, hydrogen, oxygen, nitrogen and/or sulfur.

The EPA is proposing de minimis provisions applicable to the following nine elements: aluminum, boron, calcium, sodium, zinc, magnesium, phosphorus, potassium and iron. These nine elements were selected by evaluating a number of factors. First, any element known or believed to have significant inhalation-related health effects or to be a precursor to emission species of particular concern was eliminated as a candidate for the de minimis provision. For example, elements in the halogen family were eliminated because of their occurrence in toxic chemical species. Other examples include mercury, tin, and lead, which were eliminated from consideration because of their neurologic effects, and cobalt, platinum, silicon, and antimony, which were eliminated because of concerns about their potential respiratory effects in some chemical forms. Manganese was also eliminated because its health effects are still under study.

For the group containing the nine atypical elements it appears that limited exposures to ambient concentrations of at least 0.1 milligrams of the elements per cubic meter of air ($mg/mm^3$) could occur without raising appreciable concerns. EPA estimates that a concentration of 25 parts per million (ppm) of atypical element(s) in a base fuel should generally yield a concentration in air of less than 0.1 $mg/mm^3$. Thus, EPA is proposing a de minimis provision based on a qualifying level of 25 ppm in base fuel disregarding trace amounts of the elements which may exist in the unadditized fuel. Specifically, if an atypical additive contains no atypical elements other than the nine set forth above, and if the total of these elements added to the base fuel does not exceed 25 ppm by weight when the additive is mixed into the applicable base fuel at the highest treatment rate recommended by the additive manufacturer, then the additive (and F/FAs) mixture) would qualify for the de minimis provision.

SUMMARY OF THE INVENTION

It is an object of this invention to provide a fuel composition containing a fuel additive which comprises mixtures of calcium salts with alkaline earth metal salts other than those containing calcium and/or alkali metal salts. The fuel composition of the present invention comprises (a) a major portion of a base fuel and (b) a minor amount of a fuel additive sufficient to reduce the formation of particulate emissions resulting from the combustion of said fuel, wherein the fuel additive comprises a mixture of organic and/or inorganic salts consisting essentially of (i) calcium salts and (ii) salts of at least one metal selected from the group consisting of alkali metals, alkaline earth metals other than calcium, and mixtures thereof, preferably delivered in the form of solutions, colloidal dispersions, or micelles.

It is also an object of this invention to provide fuel compositions which exhibit a significant reduction in the emission of smoke and other particulates upon supplying said fuel composition to and burning said fuel composition in a compression ignition engine.

It is also an object of this invention to provide an additive concentrate comprising a solvent or diluent and a mixture of organic and/or inorganic salts consisting essentially of (i) calcium salts and (ii) salts of at least one metal selected from the group consisting of alkali metals, alkaline earth metals other than calcium, and mixtures thereof.

Further, it is an object of this invention to provide an additive composition for reducing the particulate emission from compression ignition engines burning fuels containing said additive compositions, wherein the additives contain only elements which are covered by the de minimnis provisions set forth above.

DETAILED DESCRIPTION

The combustion of fuels result in smoke and other particulate emissions. The additives of the present invention may be added to fuels, at low levels, in order to produce fuel compositions which exhibit a reduction in exhaust particulate and smoke emissions in a compression ignition engine burning said fuel.

The fuel additives of the present invention comprise mixtures of calcium salts with at least one salt of a metal selected from the group consisting of alkaline earth metals other than calcium, alkali metals, and mixtures thereof. The metals are added in the form of metal salts, wherein the term salts is meant to include both organic and inorganic compounds of the metal, and metal delivered into the fuel as part of one or more overbased metal detergents, which may be considered to be colloidal dispersions or micelles rather than simple salts. Preferred combinations of metals are calcium+alkaline earth metal(s) other than calcium; calcium+alkali metal(s); and calcium+alkali metal(s)+alkaline earth metal (s) other than calcium.

The metal additives are exemplified by oil-soluble salts of alkali or alkaline earth metals with one or more of the following acidic substances (or mixtures thereof): (1) sulfonic acids, (2) carboxylic acids, (3) alkylphenols, (4) sulfurized alkylphenols, and (5) organic phosphorus acids characterized by at least one direct carbon-to-phosphorus linkage. Such organic phosphorus acids include those prepared by the treatment of an olefin polymer (e.g., polyisobutylene) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of the above acids are those of sodium, potassium, lithium, calcium, magnesium, strontium and barium.

The metal additives are preferably oil-soluble overbased salts of alkali or alkaline earth metals. The overbased salts are preferred as a means to add metals in a concentrated, hence cost effective, form but the metals need not be added in this form. The term "overbased" is used to designate metal salts wherein the metal is present in stoichiometrically larger amounts than the organic acid radical. This includes low base detergents (i.e., those having a TBN of about 6 to 40), as well as high base (i.e., those having a TBN of about 250 to 500) materials. The commonly employed methods for preparing the overbased salts involve heating a mineral oil solution of an acid with a stoichiometric excess of a metal neutralizing agent, such as metal oxide, hydroxide, carbonate, bicarbonate., or sulfide, carbonating the mixture in the presence of a promoter, and filtering the resulting mass. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; amines such as aniline, phenylenediamine, phenothiazine, phenyl-β-naphthylamine, and dodecylamine. A particularly effective method for preparing the overbased salts comprises mixing an acid with an excess of a basic alkaline earth metal neutralizing agent and at least one suitable promoter, and carbonating the mixture at an elevated temperature such as 60°–200° C.

Examples of overbased sulfonates include overbased lithium sulfonates, sodium sulfonates, potassium sulfonates, calcium sulfonates, and magnesium sulfonates wherein each sulfonate moiety is attached to an aromatic nucleus which in turn usually contains one or more aliphatic substituents to impart hydrocarbon solubility.

The metal carboxylates may be derived from any organic carboxylic acid. The metal carboxylates are preferably those of a monocarboxylic acid such as that having from about 4 to 30 carbon atoms . Such acids can be hydrocarbon aliphatic, alicyclic, or aromatic carboxylic acids. Monocarboxylic acids such as those of aliphatic acids acids having about 4 to 18 carbon atoms are preferred, particularly those having an alkyl group of about 6 to 18 carbon atoms. The alicyclic acids may generally contain from 4 to 12 carbon atoms. The aromatic acids may generally contain one or two fused rings and contain from 7 to 14 carbon atoms wherein the carboxyl group may or may not be attached to the ring. The carboxylic acid can be a saturated or unsaturated fatty acid having from about 4 to 18 carbon atoms. Examples of some carboxylic acids that may be used to prepare the metal carboxylates include: butyric acid; valeric acid; caproic acid; heptanoic acid; cyclohexancarboxylic acid; cyclodecanoic acid; naphthenic acid; phenyl acetic acid; 2-methylhexanoic acid; 2-ethylhexanoic acid; suberic acid; octanoic acid; nonanoic acid; decanoic acid; undecanoic acid; lauric acid; tridecanoic acid; myristic acid; pentadecanoic acid; palmitic acid; linolenic acid; heptadecanoic acid; stearic acid; oleic acid; nonadecanoic acid; eicosanoic acid; heneicosanoic acid; docosanoic acid; and erucic acid.

The most preferred carboxylic acids, for preparing the oil-soluble salts of the present invention, are salicylic acids. Overbased salicylate are exemplified by lithium salicylates, sodium salicylates, potassium salicylates, calcium salicylates, and magnesium salicylates wherein the aromatic moiety is usually substituted by one or more aliphatic substituents to impart hydrocarbon solubility.

Examples of suitable overbased metal-containing phenate detergents include, but are not limited to, such substances as overbased lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility. The foregoing overbased metal detergents are often referred to as "overbased phenates" or "overbased sulfurized phenates".

Also suitable, though less preferred, are (a) the overbased lithium, sodium, potassium, calcium, and magnesium salts of hydrolyzed phospho-sulfurized olefins having 10 to 2000 carbon atoms or of hydrolyzed phospho-sulfurized alcohols and/or aliphatic-substituted phenolic compounds having 10 to 2000 carbon atoms. Other similar overbased alkali and alkaline earth metal salts of oil-soluble organic acids are suitable, such as the overbased aliphatic sulfonate salts, often referred to as "petroleum sulfonates". Mixtures of salts of two or more different overbased alkali and/or alkaline earth metals can be used. Likewise, salts of mixtures of two or more different acids or two or more different types of acids (e.g., one or more overbased calcium phenates with one or more alcium sulfdinates) can also be used. While rubidium, cesium and strontium salts are feasible, their expense renders them impractical for most uses. Likewise, while barium salts are effective, the status of barium as a heavy metal under a toxicological cloud renders barium salts less preferred for present day useage.

Preferred metal containing detergents are calcium, sodium, potassium, and magnesium sulfonates, sulfurized phenates, carboxylates and salicylates having a total base number (TBN) per ASTM D 2896-88 of at least 200, and preferably above 250, although any combination of compounds or dispersions of the desired metals may be used.

Fuels suitable for use in the compositions of the present invention include middle distillate fuels, such as diesel fuel and low sulfur diesel fuel, a bio-diesel fuel, or mixtures of bio-diesel and middle distillate fuels. Middle distillate fuels are usually characterized as having a boiling range of 100 to 500° C., more typically 150 to 400° C. In the present context, the term "low sulfur diesel" is intended to mean diesel fuels having a sulfur content of 0.2% by weight or less based on the weight of the fuel, preferably 0.05% by weight or less. The term "bio-diesel fuel" includes all fuels derived from a petroleum or vegetable source or mixture thereof and typically contains vegetable oils or their derivatives, such as esters produced by saponification and re-esterification or trans-esterification. A typical bio-diesel fuel useful in the present invention is rapeseed methyl ester.

Fuel compositions containing a fuel and the fuel additive of the present invention give significant reductions in smoke and other particulate emissions from compression ignition engines burning said fuel. According to the present invention, low levels of metals are effective in reducing said emissions. The metals can be present in any amount sufficient to reduce emissions. Preferably the total metals from the fuel additive in the fuel compositions are less than 50 parts per million parts of fuel (ppm), most preferably less than 25 ppm. The metals are generally present in the following proportions (maximum calcium:other, wherein 'other' refers to the total non-calcium metals in the additive, to minimum calcium:other) 100:1 to 0.1:1; preferably 50:1 to 0.3:1; and most preferably 10:1 to 2:1. These proportions are based on the metals content of the additives.

The fuel compositions of the present invention may be formulated by a simple mixing of the base fuel and the additive in the desired proportions. The base fuel may be a middle distillate fuel or a bio-diesel fuel as described above. For the sake of convenience, the additive may be provided as a concentrate for dilution with fuel. Such a concentrate forms part of the present invention and typically comprises from 99 to 1% by weight additive and from 1 to 99% by weight of solvent or diluent for the additive which solvent or diluent is miscible and/or capable of dissolving in the fuel in which the concentrate is to be used. The solvent or diluent may, of course, be the fuel itself. However, examples of other solvents or diluents include white spirit, kerosene, alcohols (e.g., 2-ethyl hexanol, isopropanol and isodecanol), aromatic solvents (e.g., toluene and xylene) and cetane improvers (e.g., 2-ethyl hexylnitrate). These may be used alone or as mixtures.

The compositions of the present invention may further contain additional components conventionally used in fuel compositions such as fuel stabilizers, detergent/dispersants, fluidizer oils, anti-foams, cetane number improvers, anti-icers, combustion modifiers, cold flow improvers, corrosion inhibitors, demulsifiers, antistatic additives, biocides, lubricity additives, wax antisettling additives, antioxidants, and metal deactivators.

The various components that can be included in the fuel compositions of this invention are used in conventional amounts. Thus, the amounts of such optional components are not critical to the practice of the present invention. The amounts used in any particular case are sufficient to provide the desired functional property to the fuel composition, and such amounts are well known to those skilled in the art.

The following examples further illustrate the present invention.

EXAMPLES

The basic formulation for Examples 1 and 2, and Comparative Examples 2 and 3, excluding the metal salts listed in Table 2, is set forth below in Table 1. The amounts are based on relative mass which is the relative proportion, by weight, of the components listed in Table 1. Except for the untreated base fuel, (comparative example 1 in Table 2), the fuels tested were treated so that they all contained approximately 330 mg/liter of fuel of the basic formulation.

TABLE 1

| Basic Formulation | Relative Mass |
|---|---|
| Solvent[1] | 243.2 |
| Demulsifier[2] | 2.9 |
| Corrosion Inhibitor[3] | 4 |
| Dispersant[4] | 68.3 |
| Antifoamant[5] | 13.4 |
| Lubricity Additive[6] | 25 |

[1]2-ethyl hexanol.
[2]DISSOLVAN ® 4490-1 demulsifier, commercially available from Hoechst.
[3]HiTEC ® 536 corrosion inhibitor, commercially available from Ethyl Corporation.
[4]Ashless polyisobutylene succinimide dispersant based on 950 number average molecular weight polyisobutylene, succinic anhydride and tetraethylene pentamine.
[5]TEGOPREN ® 5851 silicone glycol antifoam, commercially available from Th. Goldschmidt AG.
[6]HiTEC ® 2658 lubricity additive, commercially available from Ethyl Corporation.

To evaluate the various additives and their effects on fuel compositions, smoke values were measured in free acceleration tests of a diesel car, running on low sulfur (<0.05% by weight of sulfur) diesel fuel. The free acceleration test provides for measurement of black smoke emissions from stationary vehicular diesel engines. The smoke absorbance (K value) is reported in Table 2. Lower numbers reflect reduced particulate emission.

TABLE 2

| | Additive(s) | Metals Content of the Fuel (mg/Kg) | Smoke Absorbance (K value) |
|---|---|---|---|
| Comparative Example 1 | none | 0 | 2.09 |
| Comparative Example 2 | Ca[7] | 19 | 2.19 |
| Comparative Example 3 | Na[8]<br>Mg[9] | 0.4<br>2.3 | 2.23 |
| Example 1 | Ca[7]<br>Mg[9] | 19<br>3.4 | 1.66 |

TABLE 2-continued

| | Additive(s) | Metals Content of the Fuel (mg/Kg) | Smoke Absorbance (K value) |
|---|---|---|---|
| Example 2 | Ca[7] | 19 | 1.54 |
| | Mg[9] | 2.3 | |
| | Na[8] | 0.4 | |

[7]Calcium added as a component part of HiTEC ® 611 detergent, an overbased calcium alkyl benzene sulfonate having a nominal total base number of about 300, commercially available from Ethyl Corporation.
[8]Sodium added as a component part of PETRONATE ® HL detergent, an organic sodium sulfonate, commercially available from Witco Chemical Corporation.
[9]Magnesium added as a component part of HiTEC ® 7637 detergent, an overbased magnesium sulfonate having a nominal total base number of about 405, commercially available from Ethyl Corporation.

The results in Table 2 indicate that the fuel additives of the present invention (Examples 1 and 2) provide fuel compositions which exhibit significantly reduced black smoke emissions compared to base fuel compositions containing no metals (Comparative Example 1), or fuel compositions containing additives outside the scope of the present invention (Comparative Examples 2 and 3) as is evidenced by the lower smoke absorbance values obtained.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

I claim:

1. A fuel composition comprising (a) a major portion of a middle distillate base fuel and (b) a minor amount of a fuel additive sufficient to reduce the formation of particulate emissions resulting from the combustion of said fuel, wherein the fuel additive comprises a mixture of salts consisting essentially of (i) calcium salts and (ii) salts of at least one metal selected from the group consisting of sodium, potassium, magnesium and mixtures thereof; wherein the anions of the metal salts are in the form of sulfonates, phenates, salicylates, carboxylates or mixtures thereof; and wherein the total metal content provided by the fuel additive is less than 50 ppm.

2. The composition of claim 1 wherein the fuel additive comprises a mixture of salts of calcium and magnesium.

3. The fuel composition of claim 1 wherein the metal salts are overbased sulfonates, phenates, salicylates, carboxylates or mixtures thereof.

4. The composition of claim 1 wherein the fuel additive comprises a mixture of salts of calcium and either sodium or potassium.

5. The fuel composition of claim 1 wherein the total metal content provided by the fuel additive is less than 25 ppm.

6. The fuel composition of claim 1 wherein the ratio of calcium present in the additive to non-calcium metal(s) present in the additive is from 100:1 to 0.1:1.

7. The fuel composition of claim 1 wherein the ratio of calcium present in the additive to non-calcium metal(s) present in the additive is from 50:1 to 0.3:1.

8. The fuel composition of claim 1 wherein the ratio of calcium present in the additive to non-calcium metal(s) present in the additive is from 10:1 to 2:1.

9. The composition of claim 1 wherein the fuel additive comprises a mixture of salts of calcium, magnesium, and either sodium or potassium.

10. The composition of claim 1 wherein the additives are delivered in the form of solutions, colloidal dispersions or micelles.

11. A fuel composition obtained by combining (a) a major portion of a middle distillate base fuel and (b) a minor amount of a fuel additive sufficient to reduce particulate emissions, wherein the fuel additive is obtained by combining salts of (i) calcium and (ii) at least one metal selected from the group consisting of sodium, potassium, magnesium and mixtures thereof; wherein the anions of the metal salts are in the form of sulfonates, phenates, salicylates, carboxylates or mixtures thereof; and wherein the total metal content provided by the fuel additive is less than 50 ppm wherein the said base fuel is a low sulfur diesel fuel having a sulfur content of 0.05% by weight or less.

12. A method for reducing the formation of exhaust particulates of an engine which comprises supplying to and burning in said engine a composition as defined in claim 1.

13. A method for reducing the formation of smoke from an engine which comprises supplying to and burning in said engine a composition as defined in claim 1.

* * * * *